United States Patent [19]

Buettner et al.

[11] Patent Number: 4,996,124

[45] Date of Patent: Feb. 26, 1991

[54] PHOTOCONDUCTOR ELEMENT, REGENERATING METHODS AND ELEMENTS USEFUL THEREIN

[75] Inventors: Albert V. Buettner, Rochester; Rodney R. Bucks; Lawrence E. Contois, both of Webster, all of N.Y.

[73] Assignee: Eastman Kodak Company, Rochester, N.Y.

[21] Appl. No.: 437,490

[22] Filed: Nov. 16, 1989

[51] Int. Cl.[5] ..... G03G 5/047

[52] U.S. Cl. ..... 430/59; 430/125

[58] Field of Search ..... 430/59, 125

[56] References Cited

U.S. PATENT DOCUMENTS 4,063,945 12/1977 Von Hoene et al. ..... 430/55

4,286,032 8/1981 Ito et al. ..... 430/126

4,340,656 7/1982 Seino et al. ..... 430/48

4,578,332 3/1986 Toda et al. ..... 430/125

4,804,602 2/1989 Buettner et al. ..... 430/42

FOREIGN PATENT DOCUMENTS 1064204 4/1967 United Kingdom .

*Primary Examiner*—John Goodrow

*Attorney, Agent, or Firm*—Dressler, Goldsmith, Shore, Sutker & Milnamow, Ltd.

[57] ABSTRACT

Techniques are provided for regenerating photoconductor elements, particularly those of the unipolar, homogeneous type. These techniques utilize a low-voltage to moderate-voltage reverse charge. Also provided are new photoconductor elements useful in the practice of such techniques.

6 Claims, No Drawings

PHOTOCONDUCTOR ELEMENT, REGENERATING METHODS AND ELEMENTS USEFUL THEREIN

FIELD OF THE INVENTION

This invention lies in the field of methods for regenerating photoconductor elements and includes new photoconductor elements which are easily regenerated.

BACKGROUND OF THE INVENTION

In conventional electrophotography processes, "ghosting" is a recognized phenomenon. Ghosting results when both the freshly made latent image and at least a portion of a previously made different latent image are concurrently developed on the same surface giving the toned surface a sort of double exposure appearance. Conventionally, ghosting is avoided or minimized by an optical erase or process control procedures in which either the charging voltage (termed $V_o$) is suitably chosen, or the exposure conditions are appropriately adjusted, or both. When, during imaging, there is neither runaway dark decay nor a large toe rise and ghost production is avoided in a previously charged and exposed photoconductor element, the element is considered to have been fully regenerated.

In certain situations, such as when complex images are generated on certain photoconductor elements with a laser scan, ghosting can not be corrected by conventional procedures. Based on experimentally derived evidence, it is theorized (and there is no intent herein to be bound by theory) that such uncorrectable ghosting is caused by trapped electrons and trapped holes.

A process and apparatus for regenerating without ghost production so-called "single use" electrophotographic film having low optical density p-type photoconductors is provided by U.S. Pat. No. 4,804,602. In accordance with this patent, the film generates mobile holes and trapped electrons throughout the thickness or bulk of the photoconductor film. The regeneration is accomplished by neutralizing the trapped electrons in the photoconductor film by recombination with mobile holes using suitable reverse charging. Such holes were photogenerated to the rear of the trapped electrons or injected from a conductive substrate and allowed to drift to, and recombine with, the trapped electrons. In the practice of such invention, an overall optical erase is used in combination with reverse charging. An optical erase is employed so that no unexposed film areas exist during such reverse charging, thereby avoiding photogeneration or injection of holes in areas of the film where there were no trapped electrons.

In the so-called NP electrophotographic process, a series of charges, and a combination of a simultaneous charge and image exposure are used, followed by an overall exposure or another charge, to produce an image over (upon) an insulating, or dielectric, layer. Thus, the field variation is over the insulator, not the photoconductor. Regeneration procedures for the NP process involve removing the differential field from the insulating layer, not the photoconductor. In these regeneration procedures, an optical erase, or overall exposure, usually in combination with a charge is generally used.

So far as now known, effective procedures for accomplishing photoconductor element regeneration and avoiding ghost production without using optical erase, or overall exposure, have not previously been known.

Also, specialized photoconductor element structures, and procedures adapted for use therewith, which accomplish regeneration and avoid ghosting, have not previously been known.

SUMMARY OF THE INVENTION

This invention provides new and improved methods for regenerating previously exposed homogeneous photoconductor elements by reverse charging without optical erase.

The invention further provides a new class of composite, multi-layer, homogeneous photoconductor elements which are regenerable.

In one mode of practicing the method of this invention, a conventional single layer photoconductor element, such as a so-called "single use" type, is regenerated by first recharging the photoconductor element with a forward charge and then subjecting it to a reverse charge.

In another mode of practicing the method of this invention, such a conventional single layer photoconductor element is regenerated by two relatively low voltage successive reverse charges having about a 13 second time interval therebetween.

In another mode of practicing the method of this invention, a composite, multi-layer homogeneous photoconductor element of this invention is regenerated by a single reverse charge.

The photoconductor elements of this invention comprise successive layers of:

(a) a substrate;

(b) an electrically conductive, hole-injecting layer;

(c) a homogeneous charge transport layer containing at least one organic photoconductor dissolved in a binder polymer; and (d) a homogeneous photoconductive charge generating layer containing a dye sensitized photoconductor.

Such a photoconductor element can be regenerated by a single simple reverse charge for hundreds of cycles with very little or no exposure memory.

The methods of the present invention are particularly suitable for regenerating unipolar, homogeneous photoconductor elements. These elements can be of the type previously considered in the art to be of the single-use, or limited-use, type. Not only can the methods of this invention be used to regenerate these elements at least a few hundred times (or cycles), but also they permit regeneration to be accomplished with no overall or optical erase at all even when the photoconductor element is repeatedly recycled and exposed with the same image in the same place.

In all modes and embodiments of the methods of this invention, a reverse charge is used to accomplish regeneration. This charge involves the use of low to moderate voltage in the range of about −100 to −300 volts. The voltage will vary from photoconductor element.

In the case of some unipolar, homogeneous photoconductor elements, application of an extra forward charge across the exposed photoconductor element is helpful in achieving photoconductor element regeneration when a subsequent reverse charge is applied in accord with this present invention.

Other and further aims, purposes, features, advantages and the like will be apparent to those skilled in the art when taken with the accompanying claims.

DETAILED DESCRIPTION

(A) General

Homogeneous, single photoconductive layer photoconductor elements, particularly in unipolar form, have desirable properties as substrates for writing high-quality graphics with a laser beam. Because of the large amount of information in high-quality graphic images, it often requires considerable time to write an image on a photoconductor element with a laser beam. For example, the film translates at only 0.35 inches per second in a laser beam testing process, and this process requires more than 50 seconds to write the 18" long image. The very low dark-decay character of homogeneous films used in this process is therefore helpful in achieving high quality so-written graphics. The actual exposure time is very short so that the high-intensity reciprocity of a homogeneous photoconductor element is also helpful. Laser beams are usually bright so that the slow speed of the photoconductor element is not a problem. Also, the variety of optical densities available can eliminate problems with interference of the laser light in such a photoconductor element.

Unipolor homogeneous photoconductor elements bearing graphics so written can be regenerated by the method of this invention.

(B) Preparation of Photoconductor Elements of the Invention

The new photoconductor elements of this invention are multilayer structures which can employ conventional substrates. The substrates are preferably in a sheet or sheet-like (including film) form and serve as the support layer for a photoconductor element of this invention. Such a substrate is relatively thermally stable, electrically insulating, and has dielectric strength. Conventional substrate materials known to the photoconductor element art can be employed, such as, for example, cellulose acetate; polystyrene; polycarbonates, polyesters, including polyethylene terephthalate (presently preferred); and the like. A present preference is to employ substrates having a thickness in the range of about 3 to about 7 mils.

The photoconductor elements of this invention employ an electrically conductive layer which is also capable of injecting holes into an adjacent functional layer (as hereinbelow described). Such a layer is comprised, on a 100 weight percent total solids, basis of at least one electrically conductive, hole injecting compound or agent that is dispersed in, and preferably dissolved in, a polymeric binder. Conductive layers are thus preferably comprised of a suitable particulate or dissolved organic or inorganic conductor or semiconductor agent distributed in a binder polymer. Examples of suitable such agents include gold and other metals with low reduction potentials, and cuprous iodide. It is presently preferred to employ cuprous iodide as the conductive hole injecting agent.

It is presently preferred to employ about 80 to about 98 weight percent of such a hole injecting, electrically conductive agent dissolved in a polymeric binder which comprises the balance of the layer.

As the binder polymer, any of the known solvent soluble, film-forming, preferably hydrophobic organic polymers which have dielectric strength, and electrical insulation properties can be used, such as, for example, polyvinyl toluene-styrene copolymers, styrene-butadiene copolymers; silicone resins; styrene-alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc.; polystyrene; nitrated polystyrene; polymethylstyrene; isobutylene polymers; polyesters, such as poly-[ethylene-co-alkylene-bis(alkylene-oxyaryl)-phenylenedicarboxylate]or poly[ethylene-co-isopropylidene-2,2-bis(ethylene-oxyphenylene)terephthalate]; phenolformaldehyde resins; ketone resins; polyamides; polycarbonates; polythiocarbonates; copolymers of vinyl haloarylates and vinyl acetate, such as poly-(vinyl-m-bromobenzoate-co-vinyl acetate); and the like.

A presently preferred binder polymer for the conductive layer is poly(vinyl formal).

The conductive agent and polymeric binder are conveniently dissolved in a volatile organic solvent which is preferably evaporable at a temperature below about 100.C. Mixtures of such solvents may be employed. Examples of suitable solvents include aromatic hydrocarbons, such as benzene, toluene, xylene, misitylene, etc.; ketones, such as acetone, 2-butanone, etc.; ethers, such as cyclic ethers, like tetrahydrofuran, methyl ethyl ether, petroleum ether, etc.; alkanols, such as isopropyl alcohol, etc.; halogenated aliphatic hydrocarbons, such as methylene dichloride, chloroform, and ethylene chloride, etc.; and the like. A presently preferred coating solvent for the conductive layer is acetonitrile.

Thus, a coating composition for a conductive layer can comprise the dissolved solids of a desired conductive layer with the total quantity of solids comprising about 2 to about 4 weight percent of such coating composition with the balance being solvent.

Such a coating composition can be coated by any convenient method of application, such as knife coating, spray coating, swirl coating, or the like. A coating technique is preferably selected to produce a uniform and homogeneous application of the coating composition. After application, the applied layer is preferably dried at temperatures in the range of 150 to 200° C. Preferably, the dried conductive layer has a thickness in the range of about 0.1 to about 0.6 microns, although thicker and thinner layers can be employed.

A charge transport layer is applied over the conductive layer. Although most charge transport agents preferentially accept and transport either positive charges (holes) which are known as p-type agents, or negative charges (electrons) which are known as n-type agents, and although some charge transport agents are known which will transport both positive and negative charges, a charge transport layer employed in the photoconductor elements of this invention employs a binder polymer wherein there is dissolved a combination of three organic photoconductors each of which is a p-type charge transport agent and such photoconductors are each selected from the class of organic photoconductors represented by the formula:

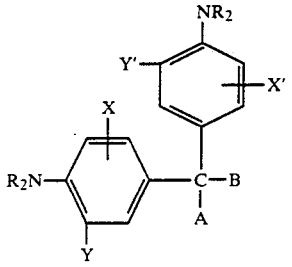

wherein

R is selected from the group consisting of alkyl, aralkyl and substituted and unsubstituted aryl;

X and X', which may be the same or different, are selected from the group consisting of hydrogen, alkyl, alkoxy, hydroxy, $NO_2$, and halogen;

Y and Y', which may be the same or different, are selected from the group consisting of hydrogen, alkyl, alkoxy, hydroxyl, halogen, and $NO_2$;

A and B, when each is taken alone, may be the same or different, are selected from the group consisting of hydrogen, alkoxy, hydroxyl, halogen, substituted or unsubstituted aryl, alkyl, cycloalkyl having four to ten carbon atoms, and cycloalkenyl having four to eight carbon atoms; and A and B, when taken together, represent the atoms required to form together with the carbon atom to which they are each attached a substituted or unsubstituted carbocyclic ring having from 4 to 10 carbon atoms.

In such a charge transport layer each organic photoconductor may be present in said layer up to the limit of its solubiilty in the polymeric binder. Also, in such a charge transport layer, at least one of the photoconductors has a structure according to Formula (1) wherein A and/or B is substituted or unsubstituted aryl.

This class of Formula (1) compounds is described in U.S. Pat. No. 4,301, 226 wherein it is taught that at least two of such organic photoconductors in an organic photoconductive layer provide a crystallization inhibiting mixture. So far as now known, neither individual Formula (1) compounds nor a combination of three thereof has previously been used in an organic charge transport layer.

While various members of this class of Formula (1) compounds can be selected for use in the present charge transport layer, it is presently preferred to employ a mixture of each of the following three compounds of Formula (1):

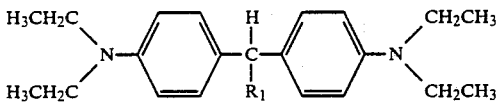

(2)

wherein:

(a) for one compound, $R_1$ is

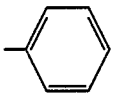

(b) for the second compound, $R_1$ is

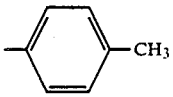

(c) for the third compound, $R_1$ is

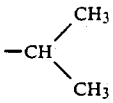

In a given charge transport layer, preferably, the weight ratio of each individual Formula (1) compound to the others thereof is in the range of about 4:2:1 to about 1:2:4. Most preferably, equal molar quantities of the compounds are employed in a given layer.

The charge transport agents are compounded with a polymeric binder. The polymeric binders can be chosen from binders previously employed in charge transport layers. The binders, for example, can be chosen from among those polymers hereinabove identified for use as binders int he conductive layer. A presently preferred binder for use in the charge transport layer of this invention is a polycarbonate; in particular, the polycarbonate available commercially from General Electric Co. under the trade designation "Lexan TM 145".

Conveniently, the selected Formula (1) compounds and the binder polymer composition are preliminarily dissolved in a carrier liquid or solvent. Suitable solvents can be selected from among those above described for the conductive layer. However, for the charge transfer layer coating composition it is presently preferred to use a mixture of chlorinated solvents, particularly a mixture of dichloromethane and 1,1,2-trichloroethane preferably in about a 4:1 weight ratio.

A charge transport layer can comprise about 20 to about 50 weight percent of said compounds of Formula (1), and, correspondingly, about 50 to about 80 weight percent of binder polymer. A charge transport layer coating composition can contain about 10 to about 20 weight percent total solids with the balance up to 100 weight percent being solvent.

A charge transport layer coating composition is conveniently applied over the conductive layer by a conventional coating technique with application of a smooth, uniform, homogeneous coating being preferred. After application, such a coating is conveniently dried at a temperature in the range of 150 to 200.C. Preferably the dried charge transport layer has a thickness in the range of about 8 to about 15 microns; however, thicker or thinner layers can be employed.

Over the charge transport layer is applied a charge generating layer which preferably contains a single p-type photoconductor which generally give good electrophotographic speeds in a dye sensitized "single layer" photoconductor film. Presently greatly preferred is the photoconductor 1,4- bis [4-N-benzyl-N-ethylamino)-2-methyl phenyl]methyl benzene which is characterized by the formula:

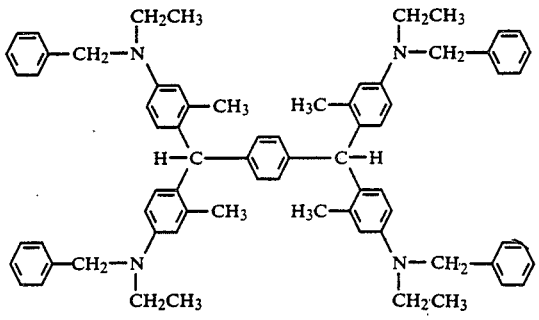

Preferably, the photoconductor in the charge generating layer is compounded with a cyanine dye sensitizer although pyryliums and other sensitizers can be used.

For purposes of the present invention, the term "dye" as used herein means a natural or synthetic colorant which is soluble in organic solvents, and sometimes in aqueous media, and which can be used in solution to stain materials. A dye characteristically consists of at least one chromophore group and at least one salt-forming group. The chromophore group(s) are responsible for the color of a dye.

Similarly, the term "cyanine dye" as used herein denotes a dye containing two heterocyclic groups (usually quinoline nuclei) connected by a chain of conjugated double bonds containing an odd number of carbon atoms. The term is inclusive of, for example, so called simple cyanines; isocyanines; merocyanines, including cyanine dyes which contain an amidic chromophore system; cryptocyanines; carbocyanines; polycarbocyanines, such as dicarboxyanine, tricarbocyanines, and the like; symmetrical as well as unsymmetrical cyanine dyes; chain-methine substituted cyanine dyes; cyanine blue; and dyes which contain the amidinium moiety, as described in the Mees and James book "The Theory of the Photographic Process", published by McMillan Co. (1966) pp. 201–202.

Presently preferred cyanine dyes have the structure:

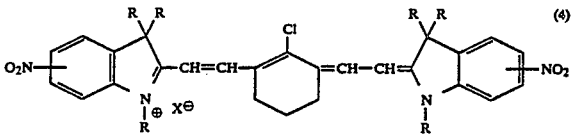

(4)

where

R is a lower alkyl group, and X is an anion.

The term "lower" as used herein before a group such as "alkyl", has reference to a group which contains less than 7 carbon atoms. A "lower alkyl" group can be branched or straight chain if it contains more than three carbon atoms.

The term "anion" as used herein designates a negatively charged ion which satisfies a net positive charge inherently associated with chromophore-group-containing organic structure.

A presently particularly preferred compound of Formula (4) is 1,3,3-trimethyl-2[7-(1,3,3=trimethyl-5-nitroindolenin-2-yl)-4-chloro-3,5-trimethylene-1,3,5-heptatienylidene-5-nitroindolium hexafluoro-phosphate which has this structure:

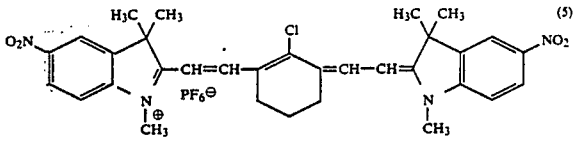

(5)

Preferably the photoconductor and the cyanine dye sensitizer are compounded with a surfactant. A presently particularly preferred surfactant is a silicone surfactant which is soluble in the carrier liquid or solvent used for coating (see below), such as the silicone surfactant available commercially from Dow Corning Co. under the trade designation "DC-510."

The polymeric binder can be chosen from among prior art binders previously employed in charge generating layers. The binders, for example, can be chosen from among those polymers hereinabove identified for use as binders in the conductive layer.

A presently preferred binder for use in the charge generating layer of this invention is comprised on a 100 weight percent polymer basis of a mixture of about 0 to about 20 weight percent of a copolymer of ethylene and neopentyl glycol and terephthalic acid with about 80 to about 100 weight percent of poly(vinyl-m-bromobenzoate)-co-(vinylacetate).

Conveniently, the photoconductor, the sensitizing dye, the surfactant, and the polymeric binder are all dissolved in a carrier liquid or solvent. Suitable solvents can be selected from among those above described in relation to the conductive layer. However, for the charge generating layer coating composition, it is presently greatly preferred to use a mixture of chlorinated solvents, such as was above described as a preference for use in formulating a charge transport layer coating composition.

A charge generating layer can comprise on a 100 weight percent total solids basis about 20 to about 40 weight percent of photoconductor about 2 to about 6 weight percent of cyanine dye sensitizer, about 0.1 to about 0.4 weight percent of silicone surfactant, and about 54 to about 78 weight percent of polymeric binder. A charge generating layer coating composition can comprise about 2 to about 6 weight percent total solids and, about 94 to about 98 weight percent of solvent.

A charge generating layer coating composition is conveniently applied over the conductive layer by a conventional coating technique with application of a smooth, uniform, homogeneous coating being preferred. After application, the coating is conveniently air dried at a temperature in the range of 150 to 200 C. Preferably, the dried charge generating layer has a thickness in the range of about 0.5 to about 3 microns; however, thicker or thinner layers can be used.

Thus, the photoconductor elements of this invention can be classified for present purposes as unipolar, homogeneous, multiple layer structures.

(C) Prior Art Photoconductor Elements

Certain types of prior art unipolar, homogeneous, single photoconductive layer containing photoconductor elements that are presently preferred for use in practicing the regenerating methods of this invention are now described.

The term "unipolar" as used herein has reference to a photoconductor element which usually conducts only one type of charge (positive or negative) and leaves the opposite charge deeply trapped. The methods of this invention are particularly well-suited for use with unipolar photoconductor elements wherein mobile holes are generated and transported leaving trapped electrons in the bulk of the photoconductor element which preferably is in film form.

The term "homogeneous" as used herein has reference to a photoconductor element which has substantially no discontinuities in its individual functional layers (i.e., conductive layer, photoconductive layer, charge transport, or charge generating layer). For example, if such a layer contains incorporated functional particles, such as, for example, colloidal pigment, metal or metal compound particles, or the like, in a binder polymer that comprises a continuous phase of such a layer, then the layer is not homogeneous and the photoconductor element containing such layer is not homogeneous. In other words, functional components of a given functional layer are dissolved in the binder polymer to form a layer, and each layer is substantially a single phase without discontinuities, such as aggregates, pigments, or the like. It is noted that it is possible that there may be some mixing between contiguous layers of a homogeneous photoconductor element, but the element is still considered to be homogeneous for present purposes.

Preferably, a photoconductor element having a single photoconductive layer employs a conventional substrate layer such as above described herein for use in the multilayer elements of this invention. Preferably, the substrate layer is overcoated with an electrically conductive hole injecting conductive layer such as above described herein for use in the multilayer elements of this invention.

Such an electrically conductive layer is preferably overcoated by a single photoconductive layer. Such a photoconductive layer preferably contains at least one photoconductor and at least one dye sensitizer therefore which are both dissolved in a binder polymer.

The binder polymer can be any of the known polymers heretofore used in the photoconductor element art as hereinabove described and illustrated.

One presently preferred class of photoconductive layers utilizes a single photoconductive compound or agent. A presently particularly preferred photoconductor is that of Formula (3).

In such a layer, the photoconductor is preferably combined with a cyanine dye such as hereinabove described (see Formula (4)). A presently particularly preferred cyanine dye is shown in Formula (5).

When a photoconductor of Formula (3) and a cyanine dye sensitizer of Formula (5) are used in combination, it is presently preferred to include a surfactant. A presently particularly preferred surfactant is the Dow Corning "DC-510" material. The binder polymer preferably employed with this combination is one such as was above described and preferred herein for use in the charge generating layer of the inventive multilayer structures. On a 100 weight percent total solids basis, such an exemplary photoconductive layer comprises:

about 18 to about 40 weight percent of photoconductor of Formula (3);

about 0.5 to about 4 weight percent of cyanine sensitizer of Formula (5);

about 0.1 to about 0.4 weight percent of "DC510" silicone surfactant; and about 55.1 to about 81.4 weight percent of binder polymer.

Another preferred class of single photoconductive layers contains a combination of the same three photoconductors as above used and described herein in relation to a charge transport layer of an inventive multilayer structure. Thus, the combination is taken from among compounds of Formula (1) and a presently preferred mixture comprises the three compounds of Formula (2).

Preferably, the combination is used with a sensitizing dye, such as a pyrylium dye.

A wide variety of pyrylium dyes are useful in such layers. These include pyrylium dyes of the formula:

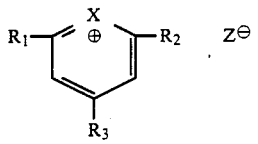

(6)

wherein:

$R_1$ and $R_2$ are each independently selected from the group consisting of phenyl lower alkyl substituted phenyl and lower alkoxy substituted phenyl;

$R_3$ is selected from the group consisting of mono(lower alkyl)amino-substituted phenyl di(lower alkyl)amino-substituted phenyl, mono(lower monohaloalkyl)amino-substituted phenyl and di(lower monohaloalkyl)amino-substituted phenyl;

X is selected from the group consisting of oxygen, sulfur, selenium and tellurium; and Z is an anion.

The term "halo" as used herein by itself or as a part of a chemical name designates a fluoro-, chloro-, bromo-, or iodo monovalent halogen atom.

The dyes used in this invention are not aggregated in a dried coated layer. Use of strongly polar organic solvents in the coating composition, for example, appears to avoid aggregation of the pyrylium compounds of Formula (6).

A presently preferred dye for use in such a photoconductive layer is a pyrylium dye identified as 2,4-bis (4-ethoxyphenyl)-6-(2,6-diphenyl-4H-pyran-4-ylidene)-methyl pyrylium fluoroborate which has the structure:

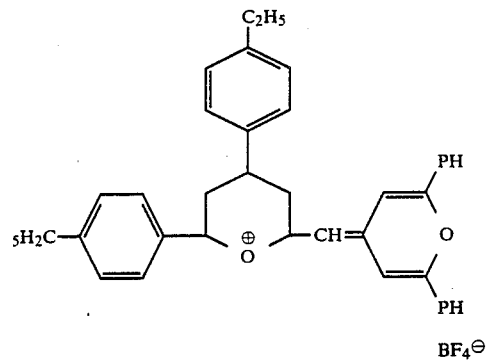

(7)

Such a combination of three Formula (2) compounds and a pyrylium dye sensitizer of Formula (7) is preferably dissolved in a binder polymer composition comprised of a mixture of at least two polyesters, a presently preferred such mixture comprising on a 100 weight percent total weight basis about 80 to about 100 weight percent of poly [ethylene-co-isopropylidene-2,2-bis-(ethylene oxyphenylene)-terephthalate and about 0 to about 20 weight percent of co-polyester of ethylene and neopentyl glycols and terephthalic acid. On a 100 weight percent total solids basis, such an exemplary photoconductive layer comprises:

about 18 to about 30 weight percent of a mixture of three photoconductors of Formula (2);

about 0.4 to about 3 weight percent of a pyrylium sensitizer of Formula (7); and about 67 to about 81.6 weight percent of polyester binder polymer.

To prepare a photoconductive layer of either class, a coating composition is prepared wherein the solids are dissolved. Such a composition can comprise about 8 to about 13 weight percent of total solids with the balance comprising solvent. The solvent can be as above described.

After coating and drying a resulting photoconductive layer preferably has a thickness in the range of about 8 to about 10 microns, although thicker and thinner such layers can be used.

(D) Regeneration Methodology

The term "reverse charging" or "reverse charge" as used herein means a charge with polarity opposite to the ordinary charge that precedes image exposure.

The term "forward charging" or "forward charge" as used herein means a charge with the same polarity as the ordinary charge that precedes the image exposure.

A low-voltage or moderate-voltage reverse charge application is believed to eliminate the trapped electrons in a homogeneous photoconductor element by Langevin bi-molecular recombination with holes injected from an injecting conductive layer. The term "low voltage" as used herein in reference to a reverse charge means a voltage in the range of about −100 to about −200 volts. The reverse charge field generated at the injecting conductive layer is higher where there are more electrons trapped in the bulk exposed areas. More holes are thus injected with exposed areas being present. Optical erase is not required or needed to eliminate electrons trapped in the bulk in the exposed areas.

The reverse charge applied is in the range of about −100 to about −300 volts applied for a time in the range of about 1 to about 3 seconds.

In the case of photoconductor elements when the low to moderate voltage reverse charge regeneration without optical erase is used cyclically with the same image being formed in the same place on the same photoconductor element many times, the image formed on the photoconductor is observed to appear in the subsequent dark-decay as an increase in dark-decay. This increase is the result of the delay between exposure and reverse charging. This delay in certain process situations cannot be shortened. Optical erasing does not reduce such dark decay.

If an optical erase is added, the reverse-voltage regeneration is delayed. This eliminates the observed residual image, but raises the dark decay to an unacceptable level. However, this procedure shows that it is the time at which the exposed film remains at low voltage fields that is the cause of the increase in dark decay. It is theorized that holes in these low field regions cannot drift out of the film, but instead have time to find shallow traps or reaction centers as they move about because of Brownian motion.

When the regeneration process is combined with the use of a specially applied forward charge voltage equal to from about $V_{white}+100$ to about $V_{zero}+100$ before the application of the reverse charge, it is found that this forward charge raises the field in the rear of the exposed areas of such a prior art photoconductor element from a value which is close to zero to a value which approximates the field as it existed before light exposure. This gives, it is theorized, some or all of the shallowly trapped in the holes an opportunity to drift to the rear of the film, as desired for combination with electrons.

The term $V_{white}$ as used herein means the surface potential to which the charged film decays in the areas of maximum image exposure. Its value is in the range of about 40 to about 200 volts.

The term $V_{zero}$ as used herein means the surface potential to which the film is charged before an image exposure. Its value is in the range of about 350 to about 500 volts. Such an applied forward charge is applied for a time of about 1 to about 3 seconds in this procedure.

Such an added forward charge also raises the field in front of the exposed areas to a level above the value existing at $V_{zero}$. If the added forward charge is too large or if the film is not too resistant to charge injection, some of the excess surface charge on the exposed area of the film may be injected into the film. If there is no injection, then the subsequent reverse charge neutralizes the extra forward surface charge.

The reverse field generated during the low-voltage reverse charge may not be high enough to remove the holes from shallow traps in the photoconductor element. To further facilitate detrapping such holes, the reverse voltage may optionally be increased from about minus 100 volts to about minus 250 volts over the time duration of reverse voltage application.

Instead of using such a combination of forward charge and reverse charge, a combination of two successively applied reverse charges may be employed if desired using a low applied reverse voltage within the range hereinabove indicated. The time interval between such charges is about 13 seconds.

When the low to moderate voltage reverse charge is applied to a photoconductive element of this invention (see above description herein) without a preliminary forward charge, it is found that the photoconductive element is regenerated without optical erase.

When the sequence of the added forward charge combined with the low voltage reverse charge is utilized with a photoconductive element of this invention as above described, it is found that the sequence completely eliminated the imagewise dark decay and kept the dark decay low. For example, no increase in dark decay was found in the area of an embodiment of the film described in Example 3 that had been exposed and regenerated 300 times. The only problem observed was a small increase in the noise of the $V_{zero}$ as a function of position. The dark decay value was good (commercially acceptable for use in a laser writing application or the like). The dark decay decreased slightly and then remained at 74 volts for 52 seconds from cycle 100 to cycle 300. All the voltages were under good control.

It is theorized that there are possibly two reasons why the two-step regeneration procedure works well with this film. For one thing, most of the lower fields in which the holes may find traps or recombination centers are in the middle or rear of the film where there is a charge transport layer that contains neither dye nor sensitizing polymer. For another thing, for the same $V_{white}$, the fields at the rear of the films are not as low, and the holes should drift to the rear surface more easily during exposure.

If one tries to reuse the photoconductor element of this invention without any optical erase and without the regeneration process of this invention, it is found that the voltages are not in control and the dark decay rises to a completely unacceptable 153 volts per 52 seconds in only 10 cycles, and to 194 volts per 52 seconds in only 100 cycles, at which point it is still rising. One cannot detect any residual image in this very high dark decay. Even with an optical erase, there is still runaway dark decay.

The invention is illustrated by the following examples:

Example 1: Unipolar Homogeneous Single Photoconductive Layer Photoconductor Element Over a 4-mils thick transparent polyethylene terephthalate film (commercially available from Eastman Kodak Co. under the trade designation Estar TM) a conductive layer was machine coated from a first coating composition which comprised, on a 100 weight percent dry weight basis, 8 weight percent cuprous iodide and 92 weight percent poly(vinyl formal). Both components were dissolved in acetonitrile to produce a coating solution comprised on a 100 weight percent total solution basis of 3.8 weight percent of total solids. This solution was coated at the rate of 30 mg/ft$^2$ dry coverage basis and after coating and drying the layer had a thickness of about 0.25 microns.

Over this conductive layer was machine coated a second coating composition which produced a photoconductive layer and which comprised on a 100 weight percent total weight basis 16 weight percent dissolved solids with the balance being a chlorinated solvent mixture. This chlorinated solvent mixture comprised dichloromethane and 1,1,2-trichloroethane. On a 100 weight percent total solids basis, the dissolved solids comprised:

| Component | Weight Percent |
|---|---|
| 1. Photoconductor of Formula (3) | 23 |

-continued

| Component | Weight Percent |
|---|---|
| 2. Cyanine dye of Formula (5) | 0.5 |
| 3 Dow Corning DC-510 silicone | 0.25 |
| 4. Binder polymer | 76.25 |

The binder polymer comprised 94 weight percent of poly(vinyl m-bromobenzoate)-co-(vinyl acetate) and 6 weight percent of a co-polyester of ethylene and neopentyl glycol and terephthalic acid. The poly(vinyl m-bromobenzoate)-co-(vinyl acetate) had the structure:

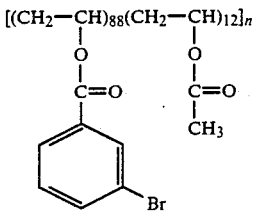

where n is an integer of about 50 to about 4000.

This second solution or coating composition was coated at the rate of 1.0 gm/ft$^2$ dry coverage. After coating and drying, the layer had a thickness of about 10 microns.

Example 2: Unipolar Homogeneous Photoconductive Layer Photoconductor Element A polyethylene terephthalate film as in Example 1 was overcoated with a conductive layer as in Example 1, except that after coating and drying the conductive layer had a thickness of 0.3 micron.

Over this conductive layer was machine coated a second coating composition which produced a photoconductive layer and which comprised on a 100 weight percent total weight basis 12 weight percent dissolved total solids with the balance up to 100 weight percent being the chlorinated solvent mixture described in Example 1. On a 100 weight percent total solids basis the dissolved solids comprised:

| Component | Weight Percent |
|---|---|
| 1. Photoconductor Mixture | 20 |
| 2. Pyrylium dye sensitizer of Formula (7) | 0.6 |
| 3. Binder Polymer Mixture | 79.4 |

The photoconductor mixture comprised the three photoconductors of Formula (2) in the weight ratio of 1:1:1.

The binder polymer mixture comprised on a 100 weight percent total polymer basis 6 weight percent copolyester of ethylene and neopentyl glycols and terephthalic acid and 94 weight percent poly [ethylene-co-isopropylidene-2,2-bis -(ethylene oxy-phenylene)terehthalate].

This second solution or coating composition was coated at the rate of 0.8 gms/ft$^2$ dry coverage. After coating and drying, the layer had a thickness of about 8 microns.

Example 3: Unipolar Homogeneous Composite Photoconductor Element

A polyethylene terephthlatate film as in Example 1 was overcoated with a conductive layer as in Example 1. After coating and drying, the conductive layer had a thickness of 0.25 microns.

Over this conductive layer was machine coated a second coating composition which produced a charge transport layer and which comprised on a 100 weight percent total weight basis 14 weight percent dissolved total solids with the balance up to 100 weight percent being the chlorinated solvent mixture described in Example 1. On a 100 weight percent total solids basis, the dissolved solids comprised:

| Component | Weight Percent |
|---|---|
| 1. Photoconductor Mixture | 35 |
| 2. Binder Polymer | 65 |

The photoconductor mixture comprised the three photoconductors of Formula (2) in the weight ratio of 1:1:1.

The binder polymer comprised a polycarbonate available commercially from General Electric Co. under the trade designation "Lexan TM 145."

This second solution or coating composition was coated at the rate of 1.0 gms/ft$^2$ dry coverage. After coating and drying, the layer had a thickness of about 10 microns.

Over this charge transport layer was machine coated a third coating composition which produced a charge generating layer and which comprised on a 100 weight percent total weight basis 4 weight percent dissolved total solids with the balance up to 100 weight percent being the chlorinated solvent mixture described in Example 1. On a 100 weight percent total solids basis, the dissolved solids comprised:

| Component | Weight Percent |
|---|---|
| 1. Photoconductor of Formula (3) | 23 |
| 2. Cyanine dye of Formula (5) | 2.4 |
| 3. Dow Corning DC-510 surfactant | 0.2 |
| 4. Binder polymer | 74.4 |

The binder polymer comprised 100 weight percent of the poly(vinyl m-bromobenzoate)-co-(vinyl acetate) described in Example 1.

This solution or coating composition was coated at the rate of 0.2 gms/ft$^2$ dry coverage. After coating and drying, the layer had a thickness of about 2 microns.

The foregoing specification is intended as illustrative and is not to be taken as limiting. Still other variations within the spirit and the scope of the invention are possible and will readily present themselves to those skilled in the art.

We claim:

1. A photoconductor element of interbonded successive layers comprising:

(a) a substrate;

(b) an electrically conductive, hole injecting layer;

(c) a charge transport layer comprising at least one organic photoconductor dissolved in a binder polymer; and (d) a charge generating layer comprising a dye sensitized photoconductor dissolved in a binder polymer;

wherein said organic photoconductor is selected from the class of compounds having the formula:

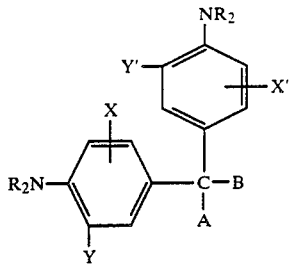

wherein

R is selected from the group consisting of alkyl, aralkyl and substituted and unsubstituted aryl;

X and X', which may be the same or different, are selected from the group consisting of hydrogen, alkyl, alkoxy, hydroxy, $NO_2$ and halogen;

Y and Y', which may be the same or different, are selected from the group consisting of hydrogen, alkyl, alkoxy, hydroxyl, halogen and $NO_2$;

A and B, when taken alone may be the same or different, are selected from the group consisting of hydrogen, alkoxy, hydroxyl, halogen, substituted or unsubstituted aryl, alkyl, cycloalkyl having four to ten carbon atoms, and cycloalkenyl having four to eight carbon atoms; or A and B, when taken together, represents sufficient atoms to form together with the carbon to which they are attached a substituted or unsubstituted carbocyclic ring having from 4 to 10 carbon atoms;

wherein each said organic photoconductor may be present in said layer up to the limit of its solubility int he binder; and wherein A and/or B in at least one of said photoconductors is substituted or unsubstituted aryl.

2. The photoconductor element of claim 1 wherein said sensitizing dye is a cyanine dye selected from the class of compounds having this formula:

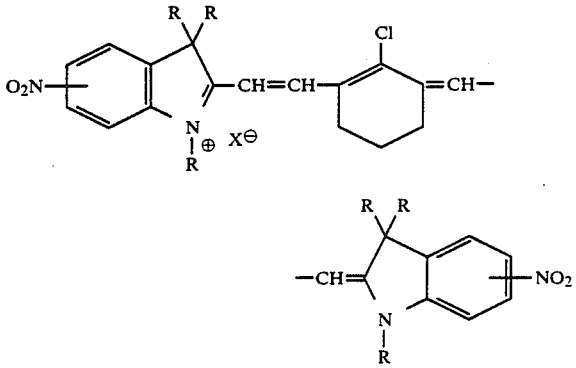

wherein:

where

R is a lower alkyl group, and X is an anion.

3. The photoconductor element of claim 1 wherein said electrically conductive, hole injecting layer has a thickness in the range of about 0.1 to about 0.5 microns and is comprised of about 80 to about 100 weight percent of cuprous iodide dissolved in about 0 to about 20 weight percent of poly(vinyl formal).

4. A process for regenerating a unipolar, homogeneous starting photoconductor element of claim 1 which has been previously exposed to actinic radiation comprising applying a low-voltage to moderate-voltage reverse charge to said photoconductor, which contains an electrically conductive majority carrier injecting conductive layer.

5. The process of claim 4 wherein said photoconductor has been forwardly charged prior to said reverse charge with a voltage in the range of about +200 to about +550 volts.

6. The process of claim 4 wherein said photoconductor after said exposure has been reversely charged prior to said reverse charge with a voltage in the range of about −100 to about −200 volts.

* * * * *